United States Patent [19]

Tobin

[11] Patent Number: 4,749,184

[45] Date of Patent: Jun. 7, 1988

[54] SELF-RESTORING KICKING PRACTICE APPARATUS

[76] Inventor: Edward D. Tobin, 1703 N. Tyland Blvd., New Haven, Ind. 46774

[21] Appl. No.: 28,313

[22] Filed: Mar. 20, 1987

[51] Int. Cl.[4] ..... A63B 69/00

[52] U.S. Cl. ..... 272/76; 272/78; 272/135; 272/DIG. 4

[58] Field of Search ..... 272/76, 77, 78, 97, 272/110, 118, 122, 128, 133, 135, 901, DIG. 4; 280/47.17, 47.23

[56] References Cited

U.S. PATENT DOCUMENTS

| | | | |
|---|---|---|---|
| 931,818 | 8/1909 | Valentine | 272/76 |
| 1,536,048 | 5/1925 | Alastalo | 272/122 |
| 3,398,953 | 8/1968 | Thompson | 272/76 X |
| 3,399,891 | 9/1968 | McCormick et al. | 272/78 |
| 3,411,798 | 11/1968 | Capadalis | 280/47.17 |
| 3,662,602 | 5/1972 | Weiss | 272/901 X |
| 3,724,845 | 4/1973 | Irby | 272/76 |
| 3,815,904 | 6/1974 | Weiss et al. | 272/901 X |
| 4,077,624 | 3/1978 | Feaser | 272/76 |
| 4,088,315 | 5/1978 | Schemmel | 272/76 |
| 4,093,212 | 6/1978 | Jacques | 272/76 |
| 4,309,029 | 1/1982 | Tomko | 272/76 |
| 4,387,892 | 6/1983 | Wen | 272/76 |
| 4,486,016 | 12/1984 | Rubin | 272/78 |
| 4,491,316 | 1/1985 | Prince | 272/78 |
| 4,564,192 | 1/1986 | Lebowitz | 272/76 |

FOREIGN PATENT DOCUMENTS

| | | | |
|---|---|---|---|
| 1506615 | 11/1967 | France | 272/76 |

OTHER PUBLICATIONS

Black Belt Magazine; 2-1987; an advertisement by Action Kickboard Co., p. 109.

*Primary Examiner*—Richard J. Apley
*Assistant Examiner*—David J. Bender
*Attorney, Agent, or Firm*—George Pappas

[57] ABSTRACT

A kicking practice apparatus including a freestanding support frame having spaced-apart upstanding members mounted at their lower ends to a floor-supported primary base and rigidly connected at their upper ends by a reinforcing structure. The upstanding members are disposed in a generally triangular arrangement. An impact-receiving member has a pivot sleeve mounting the member to a front one of the support frame members such that the impact-receiving member extends in cantilever fashion generally outwardly from the front member and away from a rear pair of the support frame members. The impact-receiving member is pivotable relative to the front member in transverse relation thereto and in either clockwise or counterclockwise directions thereabout. Sets of resiliently yieldable springs and elastic cords extend in opposing relation to one another past and in contact with the pivot sleeve and interconnect the impact-receiving member with the rear pair of members. The springs and cords impose a restoring force on the impact-receiving member and a dampening force on the pivot sleeve for maintaining the impact-receiving member at an initial rest position and returning the impact-receiving member to the rest position with occurrence of only negligible oscillation after pivoting of the impact-receiving member in either direction in response to an impact being applied to the member. Also, the support frame can include a secondary base and bracing members interconnecting the primary base and reinforcing structure with the secondary base to support the upstanding members in inclined positions.

35 Claims, 5 Drawing Sheets

SELF-RESTORING KICKING PRACTICE APPARATUS

BACKGROUND OF THE INVENTION

1. Field of the Invention

The present invention generally relates to athletic practice equipment and, more particularly, is concerned with an apparatus for practicing kicking which does not require the assistance of another person nor repeated intervention by the participant to restore the apparatus.

2. Description of the Prior Art

Kicking accuracy and speed are important skills for participants to have in several athletic endeavors, namely, karate, football and soccer, although such skills are used to achieve different results. For instance, kicking is used in karate to deliver a blow to the body of an opponent, while in football and soccer to propel a ball in a desired direction and over a desired distance. High proficiency in kicking speed and accuracy can only be attained by hours and hours of practice. Because there are typically many other demands on participants which restrict the amount of time they can devote to training, it is imperative that workout sessions be as intensive as possible with respect to the particular skills being developed and not be wasted in activities not related to improving such skills.

Historically, a wide variety of mechanical apparatuses have been employed to assist participants in practicing various athletic skills with greater intensity during their workout sessions. Representative of the prior art are the apparatuses disclosed in U.S. Pat. Nos. to Valentine (931,818), McCormick et al. (3,399,891), Irby (3,724,845), Feaser (4,077,624), Jacques (4,093,212), Tomko (4,309,029), Wen (4,387,892), Rubin (4,486,016) and Lebowitz (4,564,192) and a French patent to Alriq No. (1,506,615). Additionally, for karate kicking practice, several other prior art devices have been used heretofore, such as a heavy punching bag suspended by a rope, a ball tethered in midair by ropes attached to the floor and ceiling, and a padded hand worn like a glove by another person.

While many of these prior art practice apparatuses would appear to operate reasonably well and generally achieve their objectives under the limited range of operating conditions for which they were designed, those apparatuses used in practicing kicking seem to embody one or more of the following drawbacks which make them less than an optimum practice device. Oftentimes, the assistance of another person is required to stabilize and hold the target for each kick. This requirement not only increases the difficulty in scheduling workout sessions, but it also exposes the person doing the target-holding to injury. Some prior art apparatuses will not allow the participant to complete his or her kick follow-through which reduces the quality of the workout session. Also, many will not automatically reset or restore to their original condition after each kick, nor are they adjustable to accommodate a wide range of kicking heights. Further, the prior art apparatuses are not adapted to accurately measure the participant's kicking performance and, thus, there is no way to evaluate the progress of one's kicking proficiency.

Consequently, a need still exists for a kicking practice apparatus which is solely participant-operated, automatically restored, adjustable in height, safe to use, portable and, also, gauges performance.

SUMMARY OF THE INVENTION

The present invention provides a kicking practice apparatus designed to generally satisfy the aforementioned needs. The apparatus of the present invention basically provides a free-standing support frame and an arm pivotally mounted to the frame and holding a padded target. An arrangement of springs and elastic cords is provided between the frame and arm for applying restoring and dampening forces to the arm and its pivotal connection to the frame. Therefore, the arm is self-restoring which permits the apparatus to be used by a participant without the assistance of another person. Also, the pivotal arm can be adjusted to various heights above floor level to accommodate the particular kicking height of the participant. Further, the dampening force eliminates the occurrence of undue oscillation of the arm which means that it will quickly restore to its initial rest position and thereby reduce waiting time. The apparatus is portable so as to allow it to be taken out of storage and set up and, subsequently, taken down and returned to storage by one person. Gauging components can be coupled between the pivotal arm and stationary frame for measuring kicking performance of the participant.

In a modified embodiment of the apparatus, the upstanding members of the support frame are pivotally mounted at a primary base of the frame. In addition, the support frame is provided with a secondary base and a plurality of bracing members to laterally support the upstanding members and the primary base to allow the upstanding members to be placed in an inclined position in which the pivotal arm is more likely to be used to practice soccer or football kicking.

Accordingly, the present invention is generally directed to a kicking practice apparatus, including: (a) a freestanding support frame having first, second and third laterally spaced-apart stationary portions disposed in a generally triangular arrangement; (b) an impact-receiving member; (c) pivot means pivotally mounted the impact-receiving member to the first portion of the support frame such that the member extends in cantilever fashion generally outwardly from the first frame portion and away from the second and third frame portions and is pivotable relative to the first frame portion within a plane extending substantially transversely thereto and in a clockwise direction respectively toward and away from the second and third frame portions and a counterclockwise direction respectively away from and toward the second and third frame portions; and (d) a plurality of resiliently-yieldable flexible members extending in opposing relation to one another about and past the pivot means and interconnecting the impact-receiving member with the second and third frame portions so as to impose a restoring force on the impact-receiving member and a dampening force on the pivot means for maintaining the impact-receiving member at an initial rest position and returning the impact-receiving member to the rest position with occurrence of only negligible oscillation about the first frame portion after pivoting of the impact-receiving member in either clockwise or counterclockwise directions in response to an impact being applied to the member.

More particularly, the first, second and third spaced-apart portions of the freestanding support frame are separate spaced apart upstanding members. The support frame also includes a primary base adapted to rest on a support surface, and a reinforcing structure. The upstanding members are mounted at their lower ends on the primary base and rigidly interconnected at their upper ends by the reinforcing structure.

Still further, the impact-receiving member includes an elongated arm having opposing inner and outer ends, an impact-receiving padded target, and means releasably mounting the target on the outer end of the arm. The pivot means includes a sleeve rotatably fitted about the first frame portion and rigidly connected to the inner end of the elongated arm. A pair of annular members are disposed about and are releasably connected to the first frame portion at opposite ends of the sleeve.

Additionally, the resiliently yieldable flexible members are composed of a first set of interconnecting flexible members wherein each member is formed by a coil spring and a chain connected in series, and a second set of interconnecting flexible members wherein each member is an elastic cord. The dampening force is at least in part in the form of frictional force generated between the pivot sleeve and the first frame portion which increases in magnitude as one or the other of the elastic cords stretches when the impact-receiving member is pivoted in either direction away from the rest position.

In a modified embodiment of the kicking practice apparatus, the support frame includes a secondary base adapted to rest on a support surface and a plurality of bracing members extending between and interconnecting the secondary base with the primary base and the reinforcing structure to provide supplemental support for the upstanding members. Also, a plurality of pivot joints are provided on the support frame with each joint connecting one of the upstanding members at its lower end to the primary base. A lock sleeve is slidably fitted about each upstanding member and is adjustable therealong between a locking position in which the lock sleeve surrounds the pivot joint for locking the upstanding member in a generally upright position and an unlocking position in which the lock sleeve is displaced from the pivot joint for permitting the upstanding member to pivot at the joint relative to the primary base.

In one form thereof, the present invention relates to a kicking practice apparatus which includes a freestanding support frame having first, second and third laterally spaced-apart stationary portions disposed in a generally triangular arrangement. An impact-receiving member is provided. There is also provided a pivot means pivotally mounting the impact-receiving member to the first portion of the support frame such that the member extends in cantilever fashion generally outwardly from the first frame portion and away from the second and third frame portions and is pivotable relative to the first frame portion within a plane extending transversely thereto in a clockwise and a counterclockwise direction. A plurality of resiliently yieldable flexible members extending in opposing relation to one another past the pivot means and interconnecting the impact-receiving member with the second and third frame portions so as to impose a restoring force on the impact-receiving member and a dampening force on the pivot means for maintaining the impact-receiving member at an initial rest position and returning the impact-receiving member to the rest position with occurrence of only negligible oscillation about the first frame portion after pivoting of the impact-receiving member in either of the clockwise or counterclockwise directions in response to an impact being applied to the member is also provided.

In one form thereof, the present invention relates to a kicking practice apparatus including a freestanding support frame which itself includes a primary base, a reinforcing structure and a plurality of spaced-apart upstanding members mounted at their lower ends on the primary base and rigidly interconnected at their upper ends by the reinforcing structure. The upstanding members extend generally parallel to one another and are composed of a pair of spaced-apart rear members and a front member disposed between and forwardly of the rear members so as to provide the three members in a generally triangular arrangement. An impact-receiving member including an elongated arm having opposing inner and outer ends is provided having an impact-receiving padded target and a means releasably mounting the target on the outer end of the arm. Pivot means pivotably mount the impact-receiving member arm at its inner end to the front upstanding member of the freestanding support frame such that the arm extends generally outwardly in a cantilever fashion from the front upstanding member and away from the rear upstanding members and is pivotable relative to the front member within a plane extending in generally transverse relation thereto and in clockwise and counterclockwise directions thereabout. The pivot means includes a sleeve rotatably fitted about the front upstanding member and is rigidly connected to the impact-receiving member arm at the inner end thereof. A plurality of resiliently yieldable flexible members extend in opposing relation to one another past and in contact with the pivot sleeve and interconnect the impact-receiving arm with the rear upstanding members so as to impose a restoring force on the arm and a dampening force on the pivot sleeve for maintaining the arm at an initial rest position and returning the arm to the rest position with occurrence of only negligible oscillation about the front upstanding member after pivoting the arm in either the clockwise or counterclockwise directions in response to an impact being applied to the impact-receiving padded target on the arm.

These and other advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the accompanying drawings wherein.

Corresponding reference characters indicate corresponding parts throughout the several views of the drawings.

The exemplifications set out herein illustrate preferred embodiments of the invention in one form thereof and such exemplifications are not to be construed as limiting the scope of the disclosure or the scope of the invention in any manner.

DETAILED DESCRIPTION OF THE INVENTION

In the following description, it is to be understood that such terms as "forward", "left", "upwardly", and the like are words of convenience and are not to be construed as limiting terms.

Figure 1:
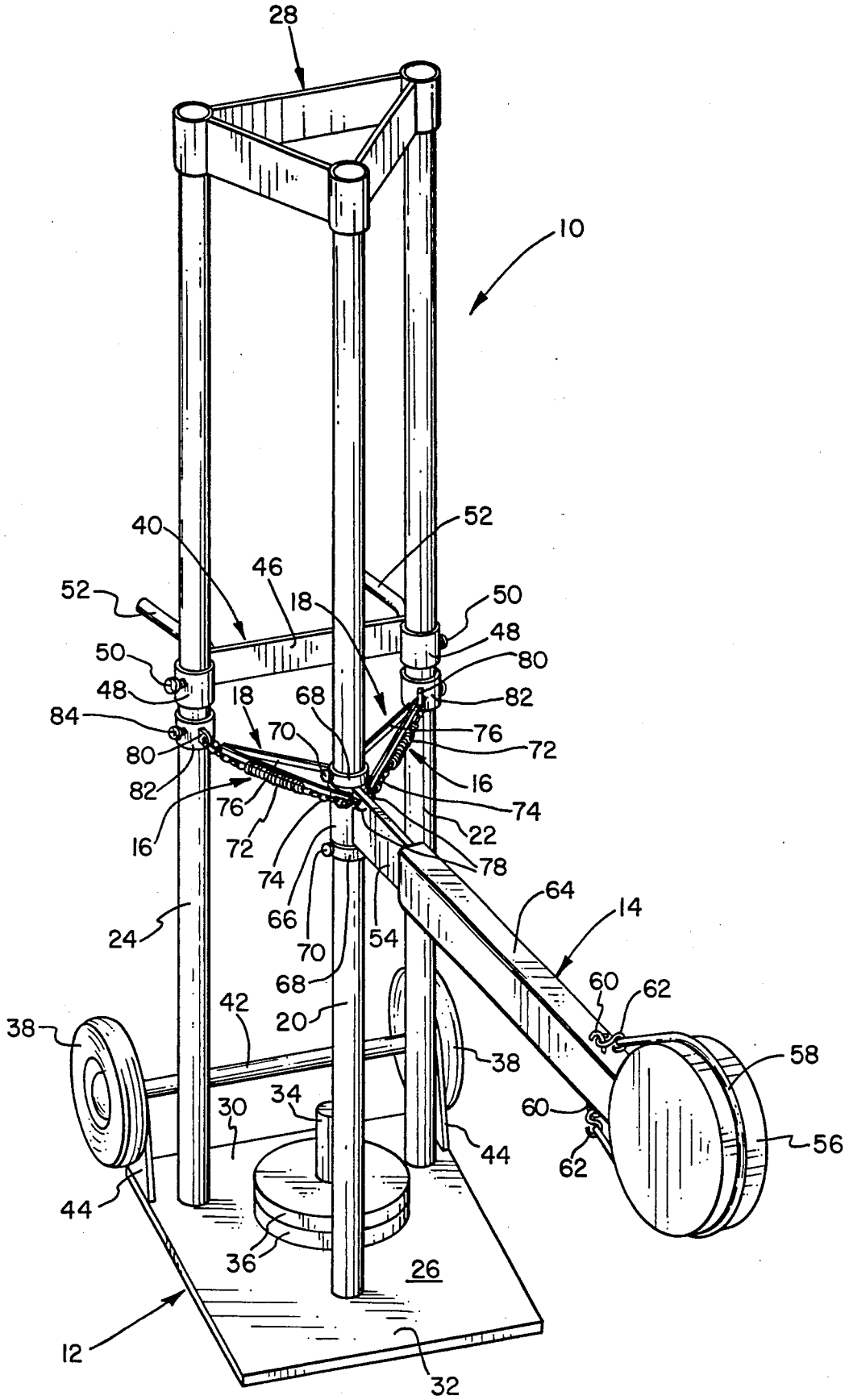
FIG. 1 is a front perspective view of one embodiment of the kicking practice apparatus according to the present invention.

Referring now to the drawings, and particularly to FIG. 1, there is shown a kicking practice apparatus, generally designated by the numeral 10 and constituting one embodiment of the present invention. In its basic components, the kicking practice apparatus 10 includes a freestanding support frame 12, an impact-receiving member 14 pivotally mounted to the support frame 12, and opposing sets of resiliently yieldable first and second flexible members 16 and 18 interconnecting the impact-receiving member 14 with the support frame 12. The first and second flexible members 16 and 18 are adapted to impose restoring and dampening forces on the impact-receiving member 14 for maintaining member 14 at an initial rest position or for returning member 14 to the rest position with occurrence of only negligible oscillation relative to the frame 12 after member 14 has pivoted in either clockwise or counterclockwise directions in response to an impact being applied thereto.

More particularly, freestanding support frame 12 includes at least three triangularly-arranged spaced-apart portions preferably constituted by a front middle upstanding member 20 and rear right and left upstanding members 22 and 24 to which are respectively mounted the impact-receiving member 14 and sets of flexible members 16 and 18. The support frame 12 also includes a primary flat base 26 adapted to rest on a support surface, such as a floor, and a triangular-shaped bracing or reinforcing structure 28. The upstanding members 20, 22, and 24 are mounted at their lower ends on the primary base 26 and rigidly interconnected at their upper ends by the reinforcing structure 28.

The front and rear upstanding members 20, 22 and 24 can be either solid or tubular cylindrical poles composed preferably of a lightweight material, such as aluminum or a suitable plastic. The upstanding members 20, 22 and 24 extend generally parallel to one another and are positioned such that the rear right and left members 22 and 24 are mounted in spaced-apart relationship along the rear end portion 30 of the primary base 26 located remote from the impact-receiving member 14. The front middle member 20 is mounted on a forward portion 32 of the primary base 26 located closer to the impact-receiving member 14. Preferably, the middle front member 20 is disposed between and forwardly of rear right and left members 22 and 24 so as to be generally equidistantly spaced therefrom to provide the upstanding members in a generally isosceles triangular arrangement.

Figure 5:
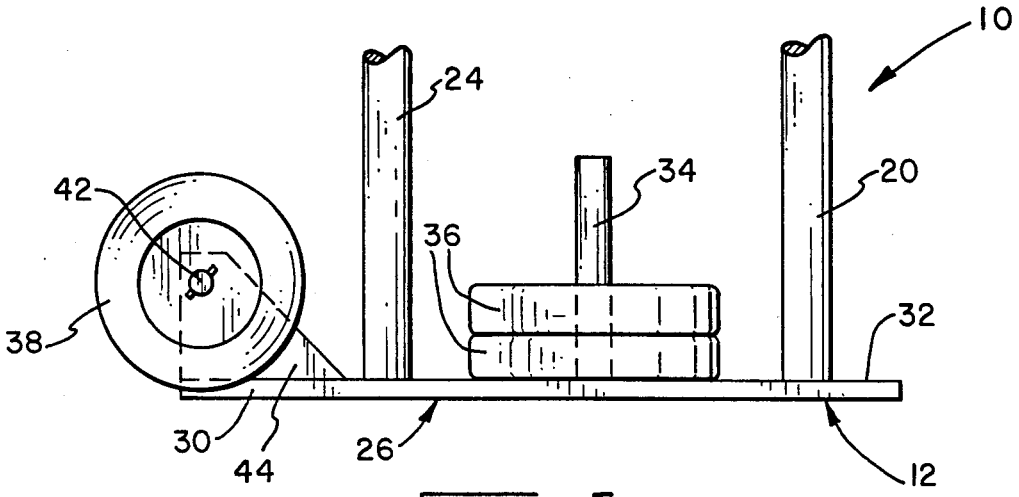
FIG. 5 is a side elevational view of a fragmentary portion of the support frame of the apparatus of FIG. 1, showing a primary base of the apparatus frame having wheels rotatably mounted thereon and weights mounted thereon for lowering the center of gravity of the apparatus.

For providing the apparatus 10 with a low center of gravity and sufficient weight to deter tipping thereof, a short post 34 adapted to receive and hold weights 36, as seen in FIG. 5 as well as in FIG. 1, is mounted upright on the primary base 26 centrally between the lower ends of the upstanding members 20, 22 and 24. Since the apparatus 10 is preferably portable in nature, the weights 36 can be removed easily by slipping them off the central post 30 when it is desired to relocate the apparatus.

To facilitate moving and relocating the apparatus 10 as desired, a pair of wheels 38 and a handle assembly 40 are provided. The wheels 38 are rotatably mounted on opposite ends of a common axle 42 and outside of respective mounting brackets 44 which support the axle 42. As also seen in FIG. 5 in addition to FIG. 1, the brackets 44 are fixed upright on opposite corners of the rear end portion 30 of the primary base 26. The wheels 38 are disposed above and out of contact with the support surface when the base 26 is resting on the support surface.

Figure 4:
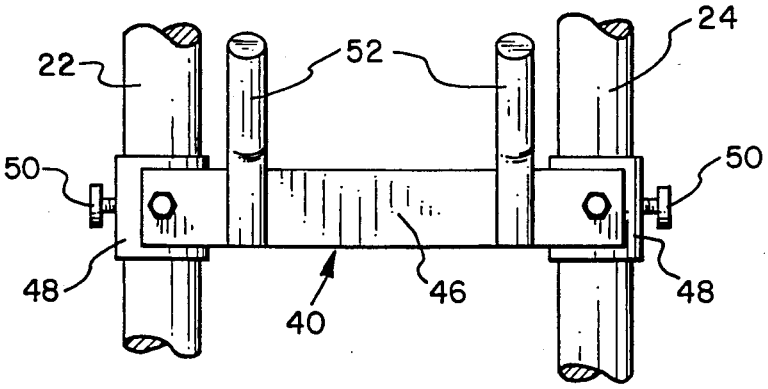
FIG. 4 is a rear elevational view of a fragmentary portion of the support frame of the apparatus of FIG. 1, showing a handle assembly mounted to the rear ones of the upstanding members of the frame.

As illustrated in FIG. 4, the handle assembly 40 includes a cross member 46 connected at its opposite ends to mounting sleeves 48 which, in turn, are releasably clamped by set screws 50 to the rear right and left upstanding members 22 and 24. The height of the handle assembly 40 above the base 26 can be changed by loosening the set screws 50, then sliding the mounting sleeves 48 in whichever desired direction upwardly or downwardly along the rear members 22 and 24, and retightening screws 50 at the new location. A pair of spaced handles 52, for use in moving the apparatus 10, are mounted to the rear side of the cross member 46.

To move the apparatus 10, it must first be tilted backwards. To do so, one foot of the person moving the apparatus 10 is placed against the rear side of the axle 42 and a backwardly-directed pulling force is applied via the handles 52 to the support frame 12. Such backward tilting of the support frame 12 causes tipping of the primary base 26 so as to bring the wheels 38 into contact with the support surface. Once the apparatus 10 has been tilted backwards sufficiently to support it on its wheels 38, it can then be rolled easily to another location.

Figure 2:
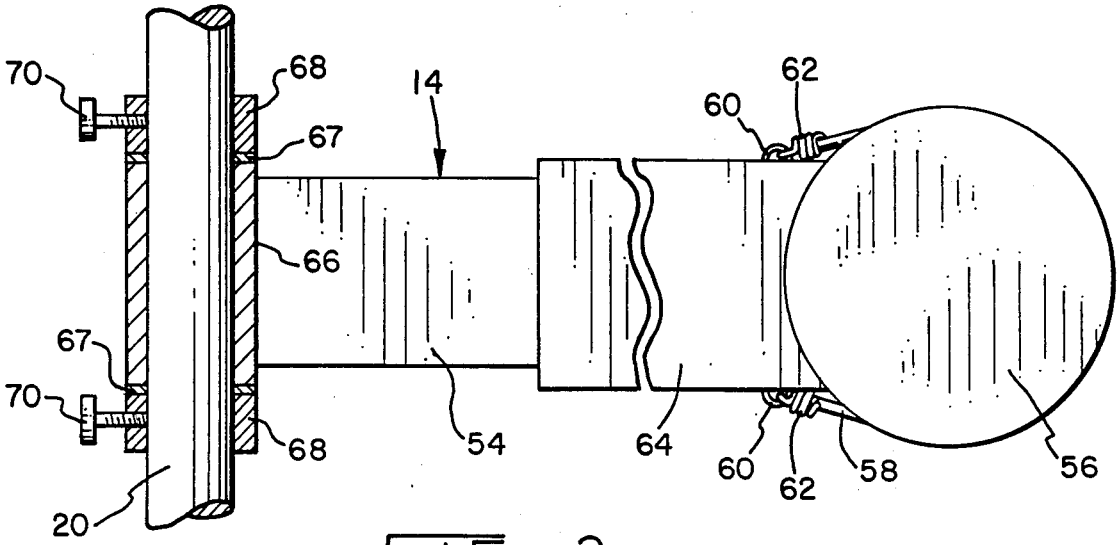
FIG. 2 is a foreshortened side elevational view of the impact-receiving member of the apparatus and the components which mount the impact-receiving member to the front one of the upstanding members of the apparatus support frame.
Figure 3:
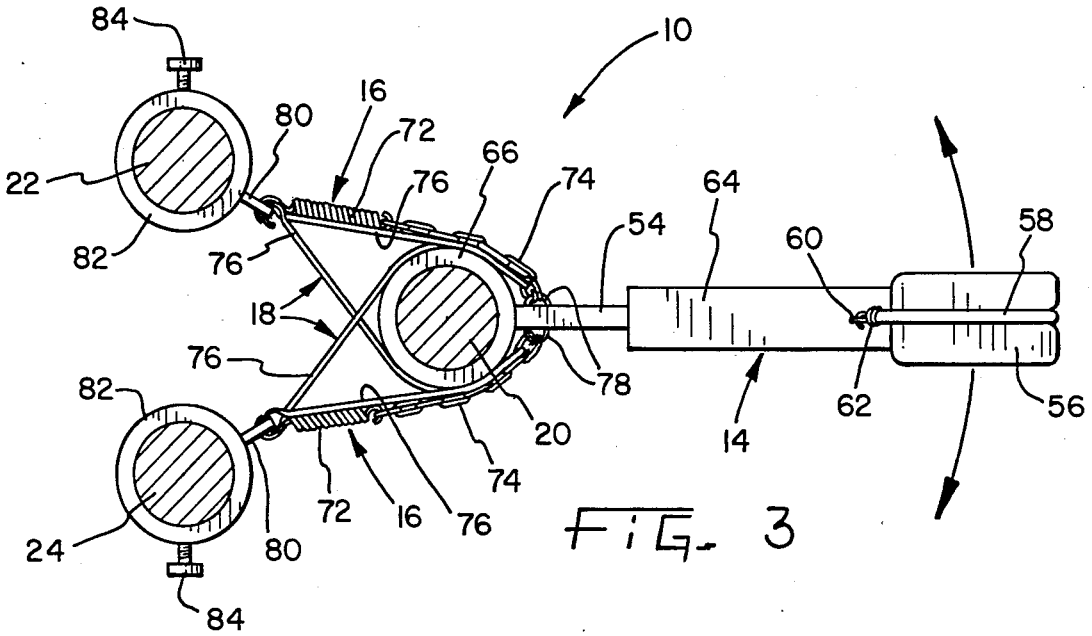
FIG. 3 is a top plan view, partly in section, of the impact-receiving member pivotally mounted to the front one of the upstanding members and of the flexible members which resiliently and yieldably interconnect the impact-receiving member with the rear ones of the upstanding members so as to generate the restoring and dampening forces.

As illustrated in FIGS. 1–3, the impact-receiving member 14 includes an elongated arm 54 having opposing inner and outer ends, an impact-receiving padded target 56 inserted on the outer end of the arm 54, and means in the form of an elastic cord or strap 58 releasably retaining the target 56 on the outer arm end. To retain the target 56 on the outer end of the arm 54, the elastic strap 58 encircles the target 56 and is coupled to hooks 60 mounted near the outer arm by S-hooks 62 attached to the opposite ends of the elastic strap 58. Also, to protect the kicking leg of the participant, preferably a padded sleeve 64 is fitted about the arm 54 and extends from the padded target 56 on its outer end toward the inner end of the arm. Padded targets having other configurations can be substituted for the one shown in the drawings. For example, a padded target shaped like a football or a soccer ball could be used instead.

The impact-receiving member arm 54 of the kicking practice apparatus 10 is pivotally mounted to the front middle upstanding member 20 of the support frame 12 by pivot means in the form of a cylindrical sleeve 66 and a pair of collars 68. The pivot sleeve 66 is sized to rotatably and slidably fit about the upstanding member 20 and is rigidly connected to the inner end of the arm 54, such as by being bonded or welded thereto. The collars 68 also rotatably and slidably fit about the front upstanding member 20. However, they have respective set screws 70 which are tightened to anchor them in fixed positions along the member 20 so as to retain the pivot sleeve 66, and thereby the arm 54, at a desired height above the primary base 26. To change the height of the arm 54, set screws 70 are untightened, sleeve 66 and collars 68 are relocated and then set screws 70 are retightened. Solid plastic bearing rings 67 are located between collars 68 and sleeve 66 although other bearings can be used.

The impact-receiving member arm 54 is fixed to the pivot sleeve 66 such that when the sleeve 66 is inserted on the front upstanding member 20, the arm 54 extends in a cantilever fashion generally outwardly from, and in orthogonal relation to, the front upstanding member 20 and away from the rear upstanding members 22 and 24. In such orientation, with respect to the support frame 12, the arm 54 is pivotable relative to the upstanding members 20, 22 and 24 within a plane extending generally transversely thereto. Referring to FIGS. 1 and 3, if the impact from a kick is received against the target 56 from its right side, the arm 54 will pivot in a clockwise direction about the front member 20 toward the rear left member 24 and away from the rear right member 22. Conversely, if the impact is received against the target 56 from its left side, the arm 54 pivots in a counterclockwise direction about the front member 20 away from the rear left member 24 and toward the rear right member 22.

As mentioned earlier, opposing sets of resiliently yieldable first and second flexible members 16 and 18 are provided in the apparatus 10 to generate restoring and dampening forces sufficient to maintain the impact-receiving member arm 54 at its centered or rest position, as seen in FIGS. 1 and 3. The forces generated by the flexible members 16 and 18 are also adapted to return the arm 54 to the rest position with occurrence of only negligible oscillation relative to the frame 12 after the arm 54 has pivoted in either clockwise or counterclockwise directions in response to an impact being applied to its target 56. The distance through which the arm 54 is pivoted from its rest position by the impact of a kick depends on how well the force of the impact counteracts the restoring and dampening forces which depend on several factors, namely, the accuracy and speed of the kick delivered to the target 56.

As seen in FIGS. 1 and 3, there are two of the first flexible members 16, with each being formed by a coil spring 72 and a link chain 74 connected in series. There are two of the second flexible members 18 also, but with each being in the form of two elastic straps or cords 76 and 77. The first flexible members 16 extend in opposing relation to each other, past opposite sides of and in contact with the pivot sleeve 66, and interconnect the impact-receiving member arm 54 at eyelets 78 thereon with one or the other of the rear upstanding members 22 and 24 at tabs 80 fixed to and extending outwardly from cylindrical connectors 82 which are, in turn, releasably attached by set screws 84 to the rear upstanding members 22 and 24. Both of the first flexible members 16 (that is, the coil springs 72 thereof) are maintained in a generally relaxed condition when the arm 54 is at its rest position. However, one or the other of the springs 72 of the first members 16 stretches or expands from its relaxed condition when the arm 54 pivots in one or the other of the directions about the front member 20 so as to generate the restoring force to return the arm 54 back to the initial rest position.

The second flexible members 18 also have elastic straps 77 which extend in opposing relation to each other, past opposite sides of and in contact with the pivot sleeve 66, and interconnect the impact-receiving member arm 54 at eyelets 78 with one or the other of the rear upstanding members 22 and 24 at tabs 80 on the connectors 82. However, unlike the first flexible members 16, the second flexible members 18 also include elastic straps 76 which cross one another to the rear of the pivot sleeve 66 and also interconnect the impact-receiving member arm 54 at eyelets 78 with one or the other of upstanding members 22 and 24 at tabs 80 on connectors 82 and are maintained in slightly stretched conditions about opposite circumferential portions of the pivot sleeve 66 when the arm 54 is at its rest position. Thus, the second flexible members 18 generate a slight restoring force which maintains the arm 54 at its initial rest position and a dampening force in the form of friction between the front upstanding member 20 and the circumferential portions of the sleeve 66 contacted by the members 18 and between upstanding member 20 and a portion of the inner diameter of sleeve 66.

When the impact-receiving member arm 54 pivots in one or the other directions about the front upstanding member 20, the corresponding second flexible members 18 stretch even further from their initial condition about an increasingly longer circumferential portion of the pivot sleeve 66 so as to generate restoring and dampening forces which increase in proportion to the amount of pivoting undergone by the arm 54. The forces are sufficient to cause return of the arm 54 to its rest position with only minimal or negligible oscillation. For example, if the impact against the arm 54 causes it to pivot at a large angle in the clockwise direction from its rest position, the dampening force will only allow it to overshoot the rest position in the counterclockwise direction one time by a generally small angle.

Whenever the height of the impact-receiving member arm 54 above the base 26 is changed, the heights of the connectors 82 must also be changed. This is accomplished by, first, unloosening the set screws 84, next, slidably adjusting the connectors 82 along the respective rear upstanding members 22 and 24 to displace them to the height above the primary base 26 which corresponds to the height of the pivot sleeve 66 thereabove, and, then, retightening the set screws.

Figure 7:
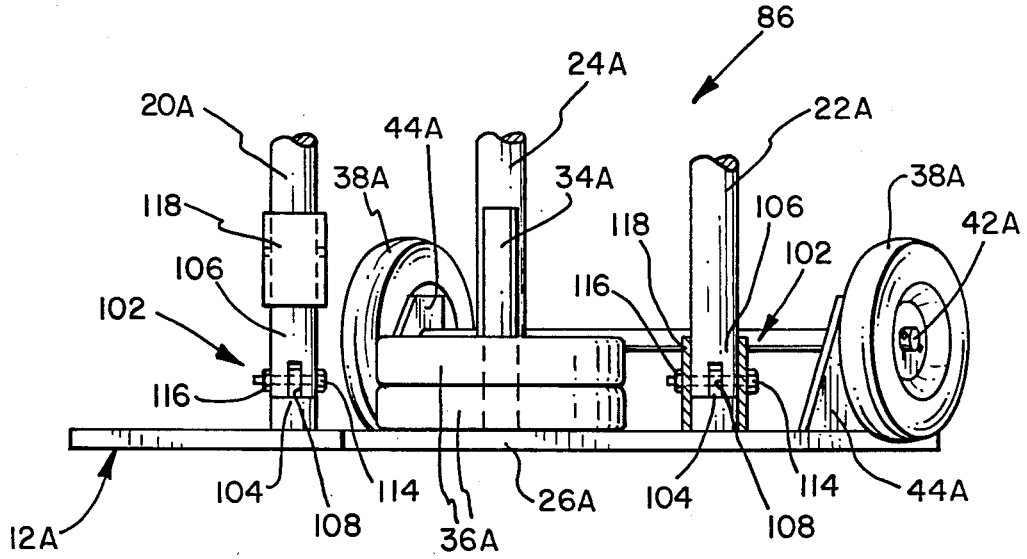
FIG. 7 is a side elevational view similar to that of FIG. 5, but showing pivot joints connecting the lower ends of the upstanding members to the primary base and also showing lock sleeves mounted for slidable movement along the upstanding members.
Figure 6:
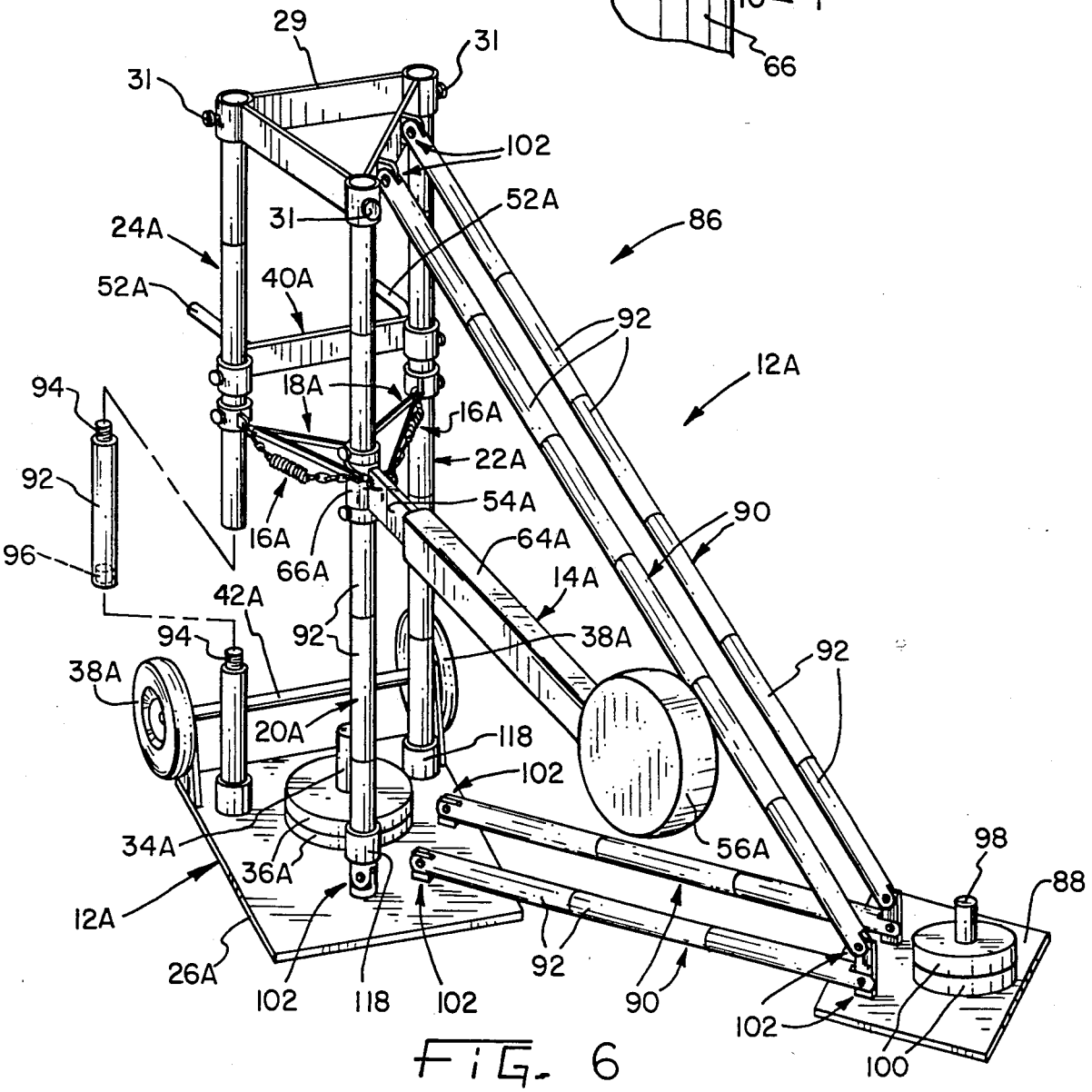
FIG. 6 is a front perspective view of a modified embodiment of the kicking practice apparatus according to the present invention.
Figure 8:
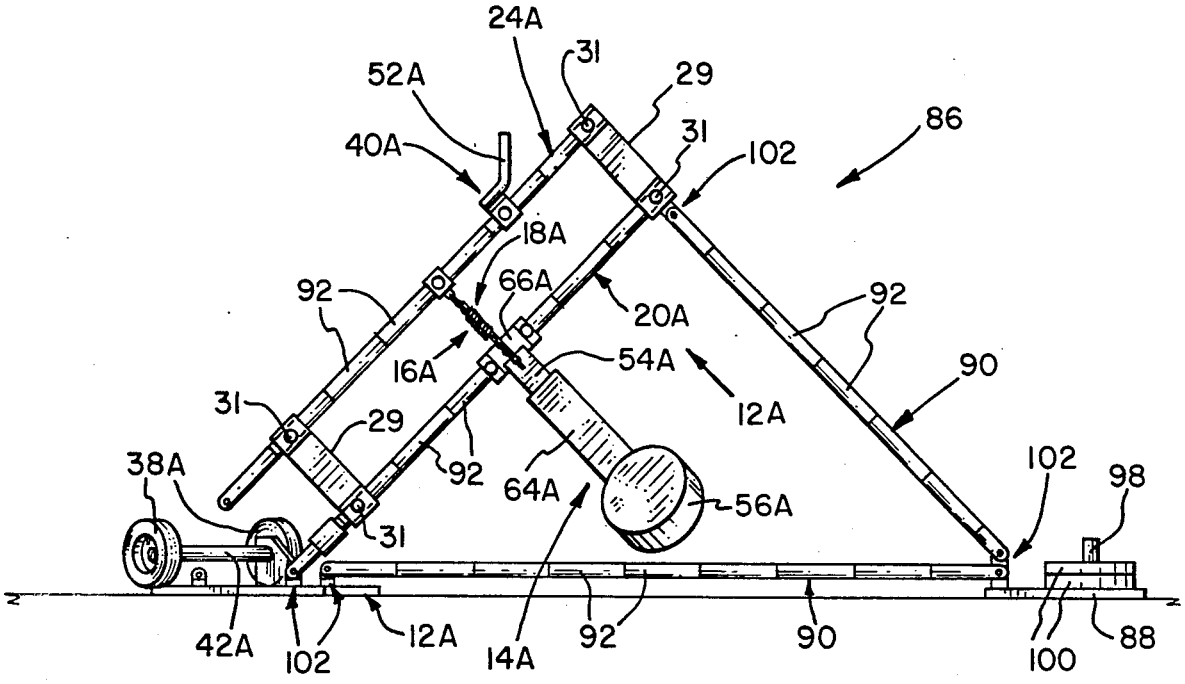
FIG. 8 is a side elevational view of one possible position of the modified embodiment of the apparatus of FIG. 6, showing the secondary base and bracing members supporting the upstanding members and the impact-receiving member in a respective inclined position.

FIGS. 6–8 illustrate a modified embodiment of the kicking practice apparatus, being designated by the numeral 86, which is generally better adaptable than the apparatus 10 of FIG. 1 to accommodate kicking practice for football or soccer. It includes the same basic components as in the earlier embodiment of FIG. 1 which components will be identified by the same reference numerals together with "A" added thereto as a suffix. The new components not found in the earlier embodiment will now be described.

The freestanding support frame 12A of the apparatus 86 additionally includes a secondary base 88 adapted to rest on the support surface and a plurality of bracing members 90 extending between and interconnecting the secondary base with the primary base 26A and the reinforcing structure 29. Reinforcing structure 29 is slidably received on upstanding members 20A, 22A and 24A and is connected thereto through the use of bolts 31. As shown in FIG. 8, a second reinforcing structure 29 is utilized at the lower end of upstanding members 20A, 22A and 24A so as to retain upstanding member 24A substantially at the same distance from upstanding members 20A and 22A as when the upstanding members are substantially upright as shown in FIG. 6. The secondary base 88 and bracing members 90 provide supplemental support for the upstanding members 20A, 22A and 24A, especially when they are disposed in the inclined positions shown in FIG. 8.

In order to change the lengths of the respective upstanding and bracing members 20A, 22A and 24A and 90, each can be composed of a plurality of short segments 92. Each of the segments 92 has an externally-threaded portion 94 on one end and an internally-threaded portion 96 on an opposite end so that the segments can be connected together end-to-end to form the upstanding and bracing members. Also, as in the case of the primary base 26A, a post 98 is mounted centrally on the secondary base 88 for securing weights 100 thereon.

Figure 7A:
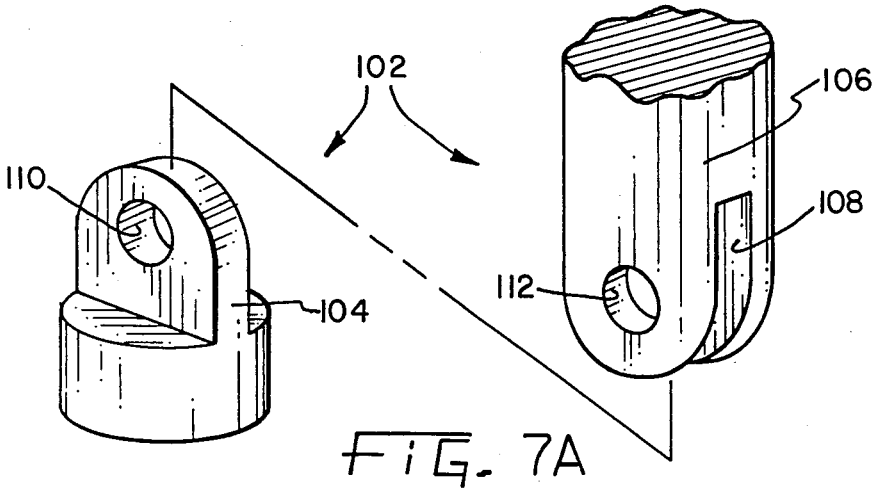
FIG. 7A is an enlarged exploded view of one of the pivot joints of FIG. 7.

In order to be able to pivot the upstanding members 20A, 22A and 24A of the support frame 12A to set the frame in a desired inclination, pivot joints 102 are provided at the lower ends of the upstanding members 20A, 22A and 24A and at the opposite ends of the bracing members 90. In FIG. 7A, a construction representative of all of the pivot joints 102 is illustrated. The joint 102 includes a tongue portion 104 attached to the respective base 26A or 88 or to the reinforcing structure 28A, and an end portion 106 of each of the respective members 20A, 22A and 24A and 90 having a groove 108 defined therein and being sized to receive the tongue portion 104. An aperture 110 is defined through the tongue portion 104 which aligns with a pair of apertures 112 defined through the end portion 106 when the tongue portion 104 is inserted in the groove 108. A bolt 114 is then inserted through the aligned apertures 110 and 112 and a nut 116 is applied to the bolt 114 to retain the parts of the joint 102 together.

If it is desired to maintain the upstanding members 20A, 22A and 24A in upright positions, as seen in FIGS. 6 and 7, a lock sleeve 118 slidably fitted about each member is provided for this purpose. The sleeve 118 can be adjusted therealong between a locking position, being shown at the right in FIG. 7, and an unlocking position, being shown at the left in FIG. 7. In the locking position, the lock sleeve 118 surrounds the pivot joint 102 and receives the bolt 114 through openings defined in opposite sides of the sleeve which align with the apertures of the joint. In the unlocking position, the lock sleeve 118 is displaced above the pivot joint 102 for permitting the upstanding members 20A, 22A and 24A to pivot at the joint relative to the primary base 26A.

Figure 9:
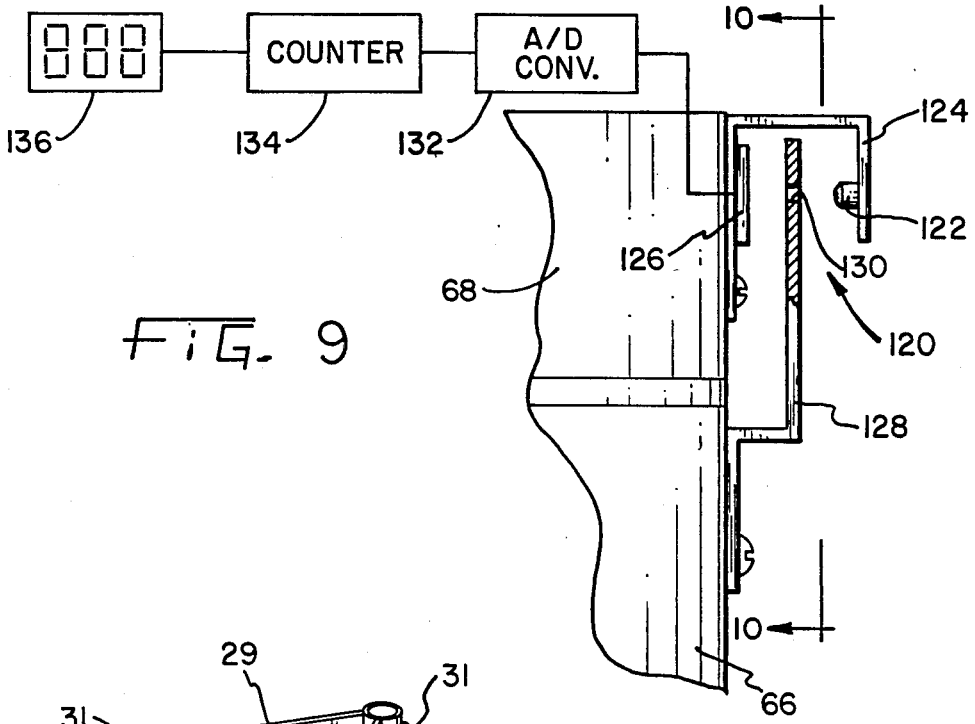
FIG. 9 is a side elevational view of the components of a sensor which detects, and generates an electrical signal proportional to, pivotal movement of the impact-receiving member, and also showing in schematic form, the electrical components for processing the electrical signal produced by the sensor.
Figure 10:
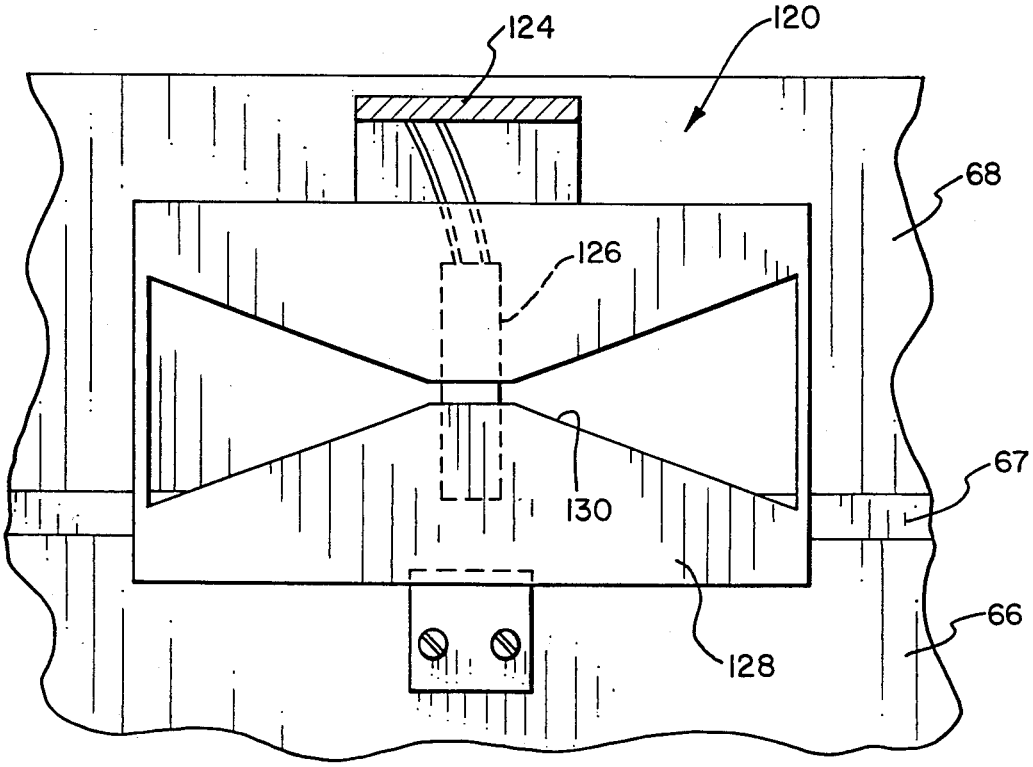
FIG. 10 is a front elevational view of the sensor as seen along line 10—10 of FIG. 9.

Turning now to FIGS. 9 and 10, the kicking practice apparatus 10 (or 86) further has means 120 for sensing the pivotal movement of the impact-receiving member arm 54 with respect to front upstanding member 20 and generating an electrical signal proportional to the degree of the movement. The sensing means 120 includes a light source 122 mounted on a bracket 124 affixed to the collar 68 on the front member 20 and facing toward a light detector 126 also mounted on the collar 68. A baffle 128 mounted to the pivot sleeve 66 for movement therewith is interposed between the light source and detector 122 and 126 and has a slot 130 defined therein which increases proportionally in width in opposite directions from its center. The slot 130 controls the amount of light that reaches the light detector 126 from the light source 122. Thus, as the arm 54 pivots, a proportionally greater amount of light is detected and an analog electrical signal such as one which varies in amplitude proportionally with the amount of light detected is produced.

Means for converting the electrical signal into an indication of the magnitude of pivotal movement of the arm 54 from its initial rest position are also provided. For example, an A/D (analog-to-digital) converter 132 which converts the analog signal to a digital signal, a digital counter 134 and a digital display unit 136 are connected in series with the sensing means 120. The counter 134 can be setup to output a count which represents the magnitude of each kick or to counter the number of times the kick exceeds a preset measurement for a unit of time.

It is thought that the kicking practice apparatus of the present invention and many of its attendant advantages will be understood from the foregoing description and it will be apparent that various changes may be made in the form, construction and arrangement of the parts and steps thereof without departing from the spirit and scope of the invention or sacrificing all of its material advantages, the form hereinbefore described being merely exemplary embodiments thereof.

What is claimed is:

1. A kicking practice apparatus, comprising:

a primary base;

a freestanding support frame having first, second and third laterally spaced-apart stationary portions disposed in a generally triangular arrangement and connected to said primary base;

an impact-receiving member;

pivot means pivotally mounting said impact-receiving member to said first portion of said support frame such that said member extends in cantilever fashion generally outwardly from said first frame portion and away from said second and third frame portions and is pivotable relative to said first frame portion within a plane extending transversely thereto in a clockwise and a counterclockwise direction; and, a plurality of resiliently yieldable flexible members extending in opposing relation to one another past said pivot means and slidingly connected to said second and third frame portions and interconnecting said impact-receiving member with said second and third frame portions so as to impose a restoring force on said impact-receiving member and a dampening force on said pivot means for maintaining said impact-receiving member at an initial rest position and returning said impact-receiving member to said rest position with occurrence of only negligible oscillation about said first frame portion after pivoting of said impact-receiving member in either said clockwise or counterclockwise directions in response to an impact being applied to said member.

2. The kicking practice apparatus as recited in claim 1, wherein said first, second and third spaced-apart portions of said support frame are separate spaced-apart upstanding members.

3. The kicking practice apparatus as recited in claim 2, wherein each of said upstanding members is composed of a plurality of short segments having an externally-threaded portion on one end and an internally-threaded portion on an opposite end for connecting said segments end-to-end to form said members.

4. The kicking practice apparatus as recited in claim 2, wherein said support frame also includes a reinforcing structure and, wherein said upstanding members are rigidly interconnected at their upper ends by said reinforcing structure.

5. The kicking practice apparatus as recited in claim 4, further comprising means for securing weights on said primary base.

6. The kicking practice apparatus as recited in claim 4, wherein said support frame further includes:

a secondary base; and a plurality of bracing members extending between and interconnecting said secondary base with said primary base and said reinforcing structure to provide supplemetal support for said upstanding members.

7. The kicking practice apparatus as recited in claim 6, further comprising means for securing weights on said secondary base.

8. The kicking practice apparatus as recited in claim 4, wherein said upstanding members extend generally parallel to one another and are positioned such tht a rear pair of said members are mounted in spaced-apart relationship on a portion of said primary base located remote from said impact-receiving member and a front one of said members is mounted on a portion of said primary base located near to said impact-receiving member.

9. The kicking practice apparatus as recited in claim 8, wherein said front member of said support frame is disposed between and forwardly of said rear members and generally equidistantly spaced therefrom to provide said members in a generally isosceles triangular arrangement.

10. The kicking practice apparatus as recited in claim 1, wherein said impact-receiving member includes:

an elongated arm having opposing inner and outer ends;

an impact-receiving padded target; and means releasably mounting said target on said outer end of said arm.

11. The kicking practice apparatus as recited in claim 10, wherein said impact-receiving member also includes a protective padded sleeve fitted about said arm and extending from said padded target on said outer end of said arm toward said inner end of said arm.

12. The kicking practice apparatus as recited in claim 10, wherein said pivot means includes:

a sleeve rotatably fitted about said first frame portion and rigidly connected to said inner end of said elongated arm; and a pair of annular members disposed about and releasably connected to said first frame portion at opposite ends of said sleeve.

13. The kicking practice apparatus as recited in claim 1, wherein said resiliently yieldable flexible members include a set of first interconnecting flexible members which extend in opposing relation to one another past and in contact wih said pivot means and interconnect said impact-receiving member with said second and third frame portions, said first interconnecting members being in a substantially relaxed condition when said impact-receiving member is at said initial rest position, one or the other of said first interconnecting members stretching from said relaxed condition upon pivoting of said impact-receiving member in one or the other of said directions so as to generate said restoring force to return said impact-receiving member to said initial rest position.

14. The kicking practice apparatus as recited in claim 13, wherein each of said first interconnecting flexible members is formed by a coil spring and a chain connected in series.

15. The kicking practice apparatus as recited in claim 13, wherein said resiliently yieldable flexible members also include a set of second interconnecting flexible members which extend in opposing relation to one another past and in contact with the pivot means and interconnect said impact-receiving member with said second and third frame portions, said second interconnecting members being in a stretched condition about a portion of said pivot means when said impact-receiving member is at said initial rest position, so as to generate a part of said restoring force for maintaining said impact-receiving member at said initial position, one or the other of said second interconnecting members stretching even further from said stretched condition about an increasing portion of said pivot means upon pivoting of said impact-receiving member in one or the other of said directions so as to proportionally increase said restoring force and said dampening force for returning said impact-receiving member to said rest position with occurrence of only negligible oscillation.

16. The kicking practice apparatus as recited in claim 15, wherein each of said second interconnecting flexible members is an elastic cord.

17. A kicking practice apparatus, comprising:

a primary base adapted to rest on a support surface;

a freestanding support frame having first, second and third separate laterally spaced-apart upstanding stationary portions disposed in a generally triangular arrangement and connected to said primary base;

an impact-receiving member;

pivot means pivotally mounting said impact-receiving member to said first portion of said support frame such that said member extends in cantilever fashion generally outwardly from said first frame portion and away from said second and third frame portions and is pivotable relative to said first frame portion within a plane extending transversely thereto in a clockwise and a counterclockwise direction;

a plurality of resiliently yieldable flexible members extending in opposing relation to one another past said pivot means and interconnecting said impact-receiving member with said second and third frame portions so as to impose a restoring force on said impact-receiving member and a dampening force on said pivot means for maintaining said impact-receiving member at an initial rest position and returning said impact-receiving member to said rest position with occurrence of only negligible oscillation about said first frame portion after pivoting of said impact-receiving member in either said clockwise or counterclockwise directions in response to an impact being applied to said member;

a reinforcing structure;

said upstanding members being rigidly interconnected at their upper ends by said reinforcing structure;

a secondary base;

a plurality of bracing members extending between and interconnecting said secondary base with said primary base and said reinforcing structure to provide supplemental support for said upstanding members; and, wherein each of said bracing members is composed of a plurality of short segments having an externally-threaded portion on one end and an internally-threaded portion on an opposite end for connecting said segments end-to-end to form said members.

18. A kicking practice apparatus, comprising:

a primary base adapted to rest on a support surface;

a freestanding support frame having first, second and third separate laterally spaced-apart upstanding stationary portions disposed in a generally triangular arrangement and connected to said primary base;

an impact-receiving member;

pivot means pivotally mounting said impact-receiving member to said first portion of said support frame such that said member extends in cantilever fashion generally outwardly from said first frame portion and away from said second and third frame portions and is pivotable relative to said first frame portion within a plane extending transversely thereto in a clockwise and a counterclockwise direction;

a plurality of resiliently yieldable flexible members extending in opposing relation to one another past said pivot means and interconnecting said impact-receiving member with said second and third frame portions so as to impose a restoring force on said impact-receiving member and a dampening force on said pivot means for maintaining said impact-receiving member at an initial rest position and returning said impact-receiving member to said rest position with occurrence of only negligible oscillation about said first frame portion after pivoting of said impact-receiving member in either said clockwise or counterclockwise directions in response to an impact being applied to said member;

a reinforcing structure;

said upstanding members being rigidly interconnected at their upper ends by said reinforcing structure;

a plurality of pivot joints, each joint connecting one of said upstanding members at its lower end to said primary base; and a lock sleeve slidably fitted about said each upstanding member and adjustable therealong between a locking position in which said lock sleeve surrounds said pivot joint for locking said upstanding member in a generally upright position and an unlocking position in which said lock sleeve is displaced from said pivot joint for permitting said upstanding member to pivot at said joint relative to said primary base.

19. A kicking practice apparatus, comprising:

a primary base;

a freestanding support frame having first, second and third laterally spaced-apart stationary portions disposed in a generally triangular arrangement and connected to said primary base;

an impact-receiving member;

pivot means pivotally mounting said impact-receiving member to said first portion of said support frame such that said member extends in cantilever fashion generally outwardly from said first frame portion and away from said second and third frame portions and is pivotable relative to said first frame portion within a plane extending transversely thereto in a clockwise and a counterclockwise direction; and, a plurality of resiliently yieldable flexible members extending in opposing relation to one another past said pivot means and interconnecting said impact-receiving member with said second and third frame portions so as to impose a restoring force on said impact-receiving member and a dampening force on said pivot means for maintaining said impact-receiving member at an initial rest position and returning said impact-receiving member to said rest position with occurrence of only negligible oscillation about said first frame portion after pivoting of said impact-receiving member in either said clockwise or counterclockwise directions in response to an impact being applied to said member;

wherein said resiliently yieldable flexible members include a set of first interconnecting flexible members which extend in opposing relation to one another past and in contact with said pivot means and interconnect said impact-receiving member with said second and third frame portions, said first interconnecting members being in a substantially relaxed condition when said impact-receiving member is at said initial rest position, one or the other of said first interconnecting members stretching from said relaxed condition upon pivoting of said impact-receiving member in one or the other of said directions so as to generate said restoring force to return said impact-receiving member to said initial rest position;

wherein said resiliently yieldable flexible members also include a set of second interconnecting flexible members which extend in opposing relation to one another past and in contact with the pivot means and interconnect said impact-receiving member with said second and third frame portions, said second interconnecting members being in a stretched condition about a portion of said pivot means when said impact-receiving member is at said initial rest position, so as to generate a part of said restoring force for maintaining said impact-receiving member at said initial position, one or the other of said second interconnecting members stretching even further from said stretched condition about an increasing portion of said pivot means upon pivoting of said impact-receiving member in one or the other of said directions so as to proportionally increase said restoring force and said dampening force for returning said impact-receiving member to said rest position with occurrence of only negligible oscillation; and, wherein said dampening force is at least in part in the form of frictional force generated between said pivot means and said first frame portion which increases in magnitude as one or the other of said second interconnecting flexible members stretches even further when said impact-receiving member is pivoted in either direction away from said rest position.

20. A kicking practice apparatus, comprising:

a freestanding support frame including a primary base, a reinforcing structure, and a plurality of spaced-apart upstanding members mounted at their lower ends on said primary base and rigidly interconnected at their upper ends by said reinforcing structure, said upstanding members extending generally parallel to one another and being composed of a pair of spaced-apart rear members and a front member disposed between and forwardly of said rear members to provide said members in a generally triangular arrangement;

an impact-receiving member including an elongated arm having opposing inner and outer ends, an impact-receiving padded target, and means releasably mounting said target on said outer end of said arm;

pivot means pivotally mounting said impact-receiving member arm at its inner end to said front upstanding member of said freestanding support frame such that said arm extends generally outwardly in cantilever fashion from said front upstanding member and away from said rear upstanding members and is pivotable relative to said front member within a plane extending in generally transverse relation thereto and in clockwise and counterclockwise directions thereabout, said pivot means including a sleeve rotatably fitted about said front upstanding member and rigidly connected to said impact-receiving member arm at said inner end thereof; and a plurality of resiliently yieldable flexible members extending in opposing relation to one another past and in contact with said pivot sleeve and slidingly connected to said pair of spaced-apart rear members and interconnecting said impact-receiving member arm with said rear upstanding members so as to impose a restoring force on said arm and a dampening force on said pivot sleeve for maintaining said arm at an initial rest position and returning said arm to said rest position with occurrence of only negligible oscillation about said front upstanding member after pivoting of said arm in either said clockwise or counterclockwise directions in response to an impact being applied to said impact-receiving padded target on said arm.

21. The kicking apparatus as recited in claim 20, wherein each of said upstanding members is composed of a plurality of short segments having an externally-threaded portion on one end and an internally-threaded portion on an opposite end for connecting said segments end-to-end to form said members.

22. The kicking practice apparatus as recited in claim 20, wherein said support frame also includes:

a secondary base adapted to rest on the support surface; and a plurality of bracing members extending between and interconnecting said secondary base with said primary base and said reinforcing structure to provide supplemental support for said upstanding members.

23. The kicking practice apparatus as recited in claim 20, wherein said impact-receiving member also includes a protective padded sleeve fitted about said arm and extending from said padded target on said outer end of said arm toward said inner end of said arm.

24. The kicking practice apparatus as recited in claim 20, wherein said resiliently yieldable flexible members include a set of first interconnecting flexible members which extend in opposing relation to one another past and in contact with the pivot sleeve and interconnect said impact-receiving member arm with said rear upstanding members, said first interconnecting members being in a substantially relaxed condition when said arm is at said initial rest position, one or the other of said first interconnecting members stretching from said relaxed condition upon pivoting of said arm in one or the other of said directions so as to generate said restoring force to return said arm to said initial rest position.

25. The kicking practice apparatus as recited in claim 24, wherein each of said first interconnecting flexible members is formed by a coil spring and a chain connected in series.

26. The kicking practice apparatus as recited in claim 24, wherein said resiliently yieldable flexible members also include a set of second interconnecting flexible members which extend in opposing relation to one another past and in contact with the pivot sleeve and interconnect said impact-receiving member arm with said rear upstanding members, said second interconnecting members being in a stretched condition about a portion of said pivot sleeve, when said arm is at said initial rest position, so as to generate a part of said restoring force for maintaining said arm at said initial position, one or the other of said second interconnecting members stretching even further from said stretched condition about an increasing portion of said pivot sleeve upon pivoting of said arm in one or the other of said directions so as to proportionally increase said restoring force and said dampening force for returning said arm to said rest position with occurrence of only negligible oscillation about said front upstanding member.

27. The kicking practice apparatus as recited in claim 24, wherein each of said second interconnecting flexible member is an elastic cord.

28. The kicking practice apparatus as recited in claim 20, wherein said pivot sleeve is slidably adjustable along said front upstanding member to vary the distance of said arm from said primary base.

29. The kicking practice apparatus as recited in claim 20, further comprising:

means for sensing the pivotal movement of said impact-receiving member arm with respect to said front upstanding member and generating an electrical signal proportional thereto; and means for converting said electrical signal into an indication of the magnitude of pivotal movement of said arm from its initial rest position.

30. The kicking apparatus as recited in claim 29, wherein said means for converting said electrical signal further counts the number of times the magnitude exceeds a preset measurement per a given unit of time.

31. The kicking practice apparatus as recited in claim 20, further comprising:

a pair of wheels rotatably mounted to said primary base such that said wheels are disposed above the support surface when said base rests thereon, said wheels being brought into contact with the support surface when said base is tipped to an inclined position with respect to the support surface; and a handle assembly mounted to said rear upstanding members and adapted to be used to tilt said support frame and cause tipping of said primary base so as to bring said wheels into contact with the support surface to facilitate moving of said apparatus.

32. A kicking practice apparatus, comprising:

a freestanding support frame including a primary base, a reinforcing structure, and a plurality of spaced-apart upstanding members mounted at their lower ends on said primary base and rigidly interconnected at their upper ends by said reinforcing structure, said upstanding members extending generally parallel to one another and being composed of a pair of spaced-apart rear members and a front member disposed between and forwardly of said rear members to provide said members in a generally triangular arrangement;

an impact-receiving member including an elongated arm having opposing inner and outer ends, an impact-receiving padded target, and means releasably mounting said target on said outer end of said arm;

pivot means pivotally mounting said impact-receiving member arm at its inner end to said front upstanding member of said freestanding support frame such that said arm extends generally outwardly in cantilever fashion from said front upstanding member and away from said rear upstanding members and is pivotable relative to said front member within a plane extending in generally transverse relation thereto and in clockwise and counterclockwise directions thereabout, said pivot means including a sleeve rotatably fitted about said front upstanding member and rigidly connected to said impact-receiving member arm at said inner end thereof;

a plurality of resiliently yieldable flexible members extending in opposing relation to one another past and in contact with said pivot sleeve and interconnecting said impact-receiving member arm with said rear upstanding members so as to impose a restoring force on said arm and a dampening force on said pivot sleeve for maintaining said arm at an initial rest position and returning said arm to said rest position with occurrence of only negligible oscillation about said front upstanding member after pivoting of said arm in either said clockwise or counterclockwise directions in response to an impact being applied to said impact-receiving padded target on said arm;

a secondary base adapted to rest on the support surface;

a plurality of bracing members extending between and interconnecting said secondary base with said primary base and said reinforcing structure to provide supplemental support for said upstanding members; and, wherein each of said bracing members is composed of a plurality of short segments having an externally-threaded portion on one end and an internally-threaded portion on an opposite end for connecting said segments end-to-end to form said members.

33. A kicking practice apparatus, comprising:

a freestanding support frame including a primary base, a reinforcing structure, and a plurality of spaced-apart upstanding members mounted at their lower ends on said primary base and rigidly interconnected at their upper ends by said reinforcing structure, said upstanding members extending generally parallel to one another and being composed of a pair of spaced-apart rear members and a front member disposed between and forwardly of said rear members to provide said members in a generally triangular arrangement;

an impact-receiving member including an elongated arm having opposing inner and outer ends, an impact-receiving padded target, and means releasably mounting said target on said outer end of said arm;

pivot means pivotally mounting said impact-receiving member arm at its inner end to said front upstanding member of said freestanding support frame such that said arm extends generally outwardly in cantilever fashion from said front upstanding member and away from said rear upstanding members and is pivotable relative to said front member within a plane extending in generally transverse relation thereto and in clockwise and counterclockwise directions thereabout, said pivot means including a sleeve rotatably fitted about said front upstanding member and rigidly connected to said impact-receiving member arm at said inner end thereof;

a plurality of resiliently yieldable flexible members extending in opposing relation to one another past and in contact with said pivot sleeve and interconnecting said impact-receiving member arm with said rear upstanding members so as to impose a restoring force on said arm and a dampening force on said pivot sleeve for maintaining said arm at an initial rest position and returning said arm to said rest position with occurrence of only negligible oscillation about said front upstanding member after pivoting of said arm in either said clockwise or counterclockwise directions in response to an impact being applied to said impact-receiving padded target on said arm;

a plurality of pivot joints, each joint connecting one of said upstanding members at its lower end to said primary base; and a lock sleeve slidably fitted about said each upstanding member and adjustable therealong between a locking position in which said lock sleeve surrounds said pivot joint for locking said upstanding member in a generally upright position and an unlocking position in which said lock sleeve is displaced from said pivot joint for permitting said upstanding member to pivot at said joint relative to said primary base.

34. A kicking practice apparatus, comprising:

a freestanding support frame including a primary base, a reinforcing structure, and a plurality of spaced-apart upstanding members mounted at their lower ends on said primary base and rigidly interconnected at their upper ends by said reinforcing structure, said upstanding members extending generally parallel to one another and being composed of a pair of spaced-apart rear members and a front member disposed between and forwardly of said rear members to provide said members in a generally triangular arrangement;

an impact-receiving member including an elongated arm having opposing inner and outer ends, an impact-receiving padded target, and means releasably mounting said target on said outer end of said arm;

pivot means pivotally mounting said impact-receiving member arm at its inner end to said front upstanding member of said freestanding support frame such that said arm extends generally outwardly in cantilever fashion from said front upstanding member and away from said rear upstanding members and is pivotable relative to said front member within a plane extending in generally transverse relation thereto and in clockwise and counterclockwise directions thereabout, said pivot means including a sleeve rotatably fitted about said front upstanding member and rigidly connected to said impact-receiving member arm at said inner end thereof;

a plurality of resiliently yieldable flexible members extending in opposing relation to one another past and in contact with said pivot sleeve and interconnecting said impact-receiving member arm with said rear upstanding members so as to impose a restoring force on said arm and a dampening force on said pivot sleeve for maintaining said arm at an initial rest position and returning said arm to said rest position with occurrence of only negligible oscillation about said front upstanding member after pivoting of said arm in either said clockwise or counterclockwise directions in response to an impact being applied to said impact-receiving padded target on said arm;

wherein said resiliently yieldable flexible members include a set of first interconnecting flexible members which extend in opposing relation to one another past and in contact with the pivot sleeve and interconnect said impact-receiving member arm with said rear upstanding members, said first interconnecting members being in a substantially relaxed condition when said arm is at said initial rest position, one or the other of said first interconnecting members stretching from said relaxed condition upon pivoting of said arm in one or the other of said directions so as to generate said restoring force to return said arm to said initial rest position;

wherein said resiliently yieldable flexible members also include a set of second interconnecting flexible members in the form of elastic cords which extend in opposing relation to one another past and in contact with the pivot sleeve and interconnect said impact-receiving member arm with said rear upstanding members, said second interconnecting members being in a stretched condition about a portion of said pivot sleeve, when said arm is at said initial rest position, so as to generate a part of said restoring force for maintaining said arm at said initial position, one or the other of said second interconnecting members stretching even further from said stretched condition about an increasing portion of said pivot sleeve upon pivoting of said arm in one or the other of said directions so as to proportionally increase said restoring force and said dampening force for returning said arm to said rest position with occurrence of only negligible oscillation about said front upstanding member; and, wherein said dampening force is at least in part in the form of frictionally force generated between said pivot sleeve and said front upstanding member which increases in magnitude as one or the other of said second interconnecting flexible members stretches even further when said arm is pivoted in either direction away form said rest position.

35. A kicking practice apparatus, comprising:

a freestanding support frame including a primary base, a reinforcing structure, and a plurality of spaced-apart upstanding members mounted at their lower ends on said primary base and rigidly interconnected at their upper ends by said reinforcing structure, said upstanding members extending generally parallel to one another and being composed of a pair of spaced-apart rear members and a front member disposed between and forwardly of said rear members to provide said members in a generally triangular arrangement;

an impact-receiving member including an elongated arm having opposing inner and outer ends, an impact-receiving padded target, and means releasably mounting said target on said outer end of said arm;

pivot means pivotally mounting said impact-receiving member arm at its inner end to said front upstanding member of said freestanding support frame such that said arm extends generally outwardly in cantilever fashion from said front upstanding member and away from said rear upstanding members and is pivotable relative to said front member within a plane extending in generally transverse relation thereto and in clockwise and counterclockwise directions thereabout, said pivot means including a sleeve rotatably fitted about said front upstanding member and rigidly connected to said impact-receiving member arm at said inner end thereof;

a plurality of resiliently yieldable flexible members extending in opposing relation to one another past and in contact with said pivot sleeve and interconnecting said impact-receiving member arm with said rear upstanding members so as to impose a restoring force on said arm and a dampening force on said pivot sleeve for maintaining said arm at an initial rest position and returning said arm to said rest position with occurrence of only negligible osillation about said front upstanding member after pivoting of said arm in either said clockwise or counterclockwise directions in response to an impact being applied to said impact-receiving padded target on said arm;

wherein said pivot sleeve is slidably adjustable along said front upstanding member to vary the distance of said arm from said primary base; and, a connector releasably attached to each of said rear upstanding members and coupled to each of said flexible members, said connectors being slidably adjustable along said rear upstanding members to displace them at a distance from said primary base which corresponds to the distance that said pivot sleeve is displaced from said base.

* * * * *